US005634283A

United States Patent [19]

Kastner

[11] Patent Number: 5,634,283

[45] Date of Patent: Jun. 3, 1997

[54] RESILIENT, ALL-SURFACE SOLE

[76] Inventor: Sidney Kastner, 9590 Clement Street, LaSalle, Quebec, Canada, H8R 1T2

[21] Appl. No.: 577,554

[22] Filed: Dec. 22, 1995

Related U.S. Application Data

[63] Continuation-in-part of Ser. No. 433,055, May 3, 1995, abandoned.

[51] Int. Cl.[6] ..... A43C 15/00

[52] U.S. Cl. ..... 36/61; 36/15; 36/59 C

[58] Field of Search ..... 36/15, 59 B, 62, 36/61, 66, 67 R, 67 A, 67 B, 67 D, 71.5, 59 C

[56] References Cited

U.S. PATENT DOCUMENTS

| | | | |
|---|---|---|---|
| 3,600,831 | 8/1971 | Olsson | 36/59 R |
| 3,747,238 | 7/1973 | Jankauskas | 36/61 |
| 4,098,011 | 7/1978 | Bowerman et al. | 36/129 |
| 4,167,071 | 9/1979 | Koransky | 36/127 |
| 4,271,608 | 6/1981 | Tomuro | 36/127 X |
| 4,715,133 | 12/1987 | Hartjes et al. | 36/127 |
| 4,782,604 | 11/1988 | Wen-Shown | 36/127 |

FOREIGN PATENT DOCUMENTS

| | | |
|---|---|---|
| 2069696 | 12/1992 | Canada . |
| 2223394 | 4/1990 | United Kingdom . |
| 9107888 | 6/1991 | WIPO . |

*Primary Examiner*—Ted Kavanaugh
*Attorney, Agent, or Firm*—Watson Cole Stevens Davis, P.L.L.C.

[57] ABSTRACT

A resilient, all-surface sole for footwear in which metal studs are mounted in the sole and extend beyond the bottom surface of the sole to such an extent that when footwear embodying the sole is worn, the metal stud is depressed within the sole until the tips of the studs are substantially at the plane of the bottom surface of the sole.

19 Claims, 2 Drawing Sheets

RESILIENT, ALL-SURFACE SOLE

This application is a continuation-in-part of my application Ser. No. 08/433,055, filed May 3, 1995 now abandoned, the disclosure of which is incorporated by reference to the extent required.

The field of the present invention is soles for footwear that are particularly adapted for use in gripping a variety of surfaces. More particularly, the present invention relates to outsoles that are adapted for enabling the wearer to obtain traction on a wide variety of surfaces, e.g., sod, ice, and sleet, as well as cement and asphalt.

BACKGROUND OF THE INVENTION

Many patents have been obtained in the general field of footwear having soles that enable the user to obtain traction on surfaces that might be classified as slippery. Specifically, golf shoes are well-known in which metal studs are embedded in the sole of the shoe, and those studs extend outwardly from the bottom surface of the sole for a considerable distance. As a consequence, when such golf shoes are worn on sod, they readily penetrate the sod to such a depth that when the golfer exerts pressure on the shoe sole, the footwear will remain fixed in position on the sod despite a substantial torque being applied by the golfer as he turns during the golf shot.

Thus, a substantial industry has been developed for golf shoes. For example, in U.S. Pat. No. 3,760,514 a golf shoe is disclosed having a tungsten carbide insert in the sole. The insert extends outwardly to provide a wear resistant, spiked shoe sole particularly adapted for use on golf shoes. The spike can be molded integrally with a sole or heel.

It has also been recognized, however, that a golfer will at times walk on hard, compacted surfaces as well as sod. Thus, in a patent such as U.S. Pat. No. 4,561,197, a golf shoe is disclosed having receptacles for the spikes embedded in the shoe's outsole to relieve the spike-produced pressure points or zones that result from walking or standing on a hard surface with a conventional golf shoe. Consequently, the prior art has recognized a problem with golf shoes, which may be highly serviceable when the golfer is walking on sod, but are unstable and uncomfortable when the golfer is walking a hard surface, such as cement or asphalt.

However, it will likewise be apparent that while golf shoes may be adequate for walking on sod, and perhaps even useful when walking on a compacted surface, they are not serviceable for walking on other types of surfaces where there is a low efficient of friction between the footwear sole and the base surface. Illustrative of such surfaces are ice, sleet, grease or other hazardous surfaces. In designing a walking or running shoe, even if such slippery surfaces are encountered only intermittently, the wide variety of spiked shoes that have been developed for golfers are woefully inadequate on such surfaces.

As a consequence, when a runner is running on a variety of surfaces in a normal day's exercise, e.g., going from grass, to cement, to a patch of grease, to a patch of ice, the shoes presently available, and in particular those that are directed to the highly developed state-of-the-art relating to golf shoes, are not adequate.

It is, therefore, a primary object of the present invention to provide a sole for footwear that will be serviceable over a wide variety of surfaces, regardless of the hardness of those surfaces and the coefficient of friction between those surfaces and the bottom of the footwear soles.

It is a secondary object of this invention to provide such a sole that is able to be used not only in permanent footwear, but which is also suitable for application to existing footwear in order to convert that footwear into shoes suitable for running or walking on a wide variety of surfaces.

SUMMARY OF INVENTION

In one form, the present invention of a resilient, all-surface sole for footwear begins with a sole that has a bottom surface and an upper surface and is formed from resilient material, such as natural or synthetic rubber, or a synthetic resin such as polyurethane, which material has a substantial thickness and is subject to compressive deformation. In this sole there are a plurality of metal studs mounted so that they extend beyond the bottom surface of the sole. Each of the studs has an anchoring portion embedded in and surrounded by the resilient material of the sole in such a manner that it is not dislodged under normal use of the footwear, a shaft portion fixed to the anchoring portion and extending away from the anchoring portion, and a tip portion in which the shaft portion terminates. It is significant to the present invention in this form that the tip portion extend outwardly beyond the plane of the bottom sole surface.

It is important to the present invention that there be a correlation between the deformability of the resilient material from which the sole is formed and the distance that the tip portion of the metal stud extends beyond the plane of the bottom surface of the sole. Expressed in terms of function, those two parameters should be coordinated such that when pressure is exerted on the metal studs by the weight of a wearer of the footwear, such pressure will cause the studs to retract within the resilient sole until the tip of the stud is substantially at the plane of the bottom surface of the sole.

In another embodiment of my invention, the same resilient sole for footwear is provided. Here, however, there are a plurality of cleats formed from a second resilient material, which cleats are attached to and spaced along the bottom surface of the sole. The cleats terminate outwardly in a lower surface to contact the surface on which the wearer walks. A plurality of metal studs are provided and attached to the sole, and such studs extend axially through at least some of the cleats.

With regard to the metal studs, they, as with my prior embodiment, have an anchoring portion embedded in and surrounded by the resilient material of the sole and secured by such material against dislodgement under normal use of the footwear. Each stud also has a shaft portion fixed to and extending away from the anchoring portion substantially axially with the cleat, as well as a tip portion in which the shaft portion terminates. The tip portion extends outwardly of the plane of the lower surface of the cleat. In this embodiment there is coordination between the compressive deformation of the resilient material of the sole and the second resilient material of the cleat, on the one hand, and the distance that the tip portion of the stud extends beyond the plane of the cleat lower surface, on the other. When the footwear is worn, the pressure exerted on the metal stud tip portions by the weight of the wearer will cause the studs to retract within the resilient sole material and resilient cleats material until the tip of the stud is substantially at the plane of the lower surface of the cleat. With regard to both embodiments of my invention, there are certain other features that are present. Thus, the hardness of the resilient material for the sole and/or the cleat can vary between about 65 to 90 Durometer Shore A, more preferably between about 70 and 80 Durometer Shore A. The sole and/or cleat may be formed from natural or synthetic rubber, or from a synthetic resin. The tip portion of the metal stud may extend in an unworn shoe sole from about 0.085 to 0.095 inch beyond the plane of the bottom surface of the sole or, where there is a cleat, of the cleat.

Also, when there are cleats, about 15 to 40 percent of the cleats have metal studs extending through them, while the remainder do not. Of the entirety of the cleats about 10 to 30 percent have resilient nipples extending outwardly from their lower surfaces, rather than metal studs, and cleats without nipples or metal studs may also be present. As one additional feature of either embodiment, the upper surface of the sole may be coated with a layer of adhesive so that the sole can be fixed to the sole of existing footwear, rather than being utilized as a sole for newly manufactured goods.

These and other objects, features and advantages of my invention will become more apparent when considered in connection with preferred embodiments of my invention as described in the specification hereinafter and as illustrated in the accompanying drawings, in which.

Figure 1:
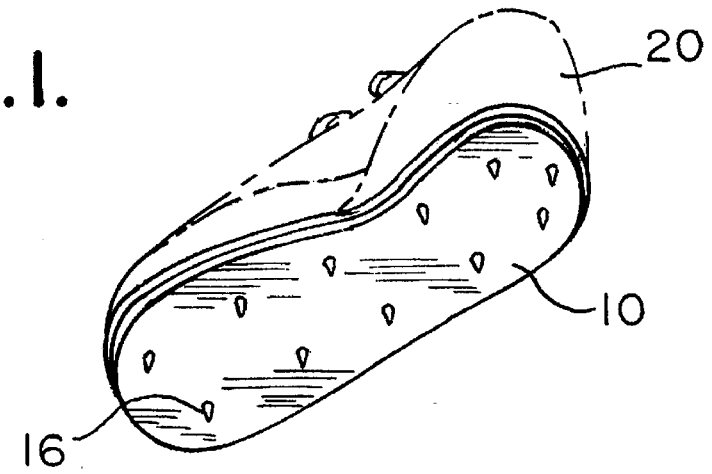
FIG. 1 is a perspective view of footwear having an all-surface sole according to one embodiment of my invention.

Referring now to the drawings, and in particular to FIGS. 1 to 4, what is shown there is a replaceable, all-surface sole 10 adapted to be permanently attached to any kind of footwear 20. Sole 10 has an upper surface 12 provided with a layer of adhesive material 22, which may be applied just before attachment of the sole 10 to the footwear by means of an applicator containing adhesive (not shown), or by means of a layer of adhesive preliminarily applied and covered by a protective paper liner 24. Liner 24 is removed to expose the layer of adhesive 22, and the liner is withdrawn immediately prior to attachment of the sole 10 to footwear which already has a sole. Such footwear may be new or having a sole that is in need of repair.

Figure 5:
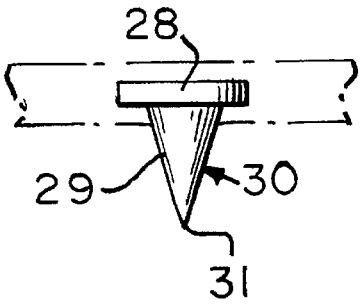
FIG. 5 is an enlarged, fragmentary view of one embodiment of a metal stud according to my invention.
Figure 6:
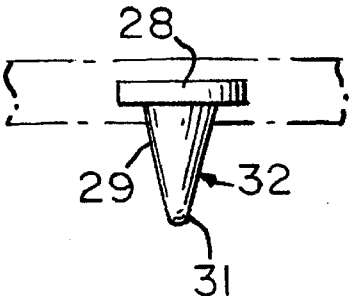
FIG. 6 is an enlarged, fragmentary view showing a different metal stud according to my invention.
Figure 7:
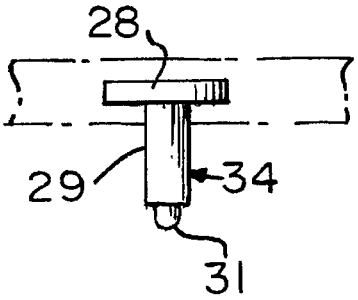
FIG. 7 is an enlarged, fragmentary view illustrating still another metal stud according to my invention.

Sole 10 has a bottom surface 14 which is supplied with a plurality of metal studs 16, which project downwardly and outwardly from the bottom surface and are adapted to provide a non-skidding function for the footwear when engaged with a walking or running surface. As best seen in FIGS. 5 to 7, which are embodiments of different studs, the studs have an anchoring portion 28, a cylindrical or conical shank or shaft portion 29, and a tip portion 31.

Figure 2:
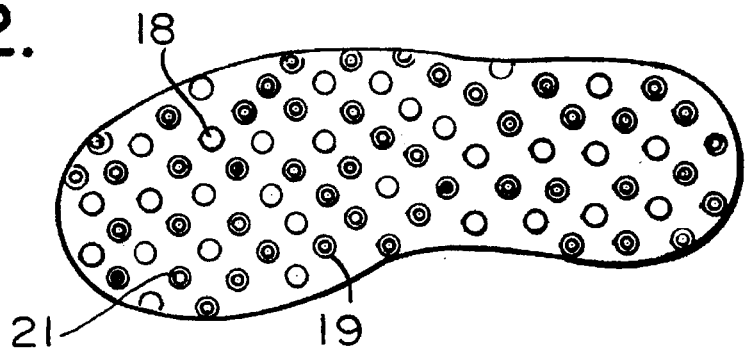
FIG. 2 is a bottom plan view of a modified embodiment of the sole of my invention.
Figure 3:
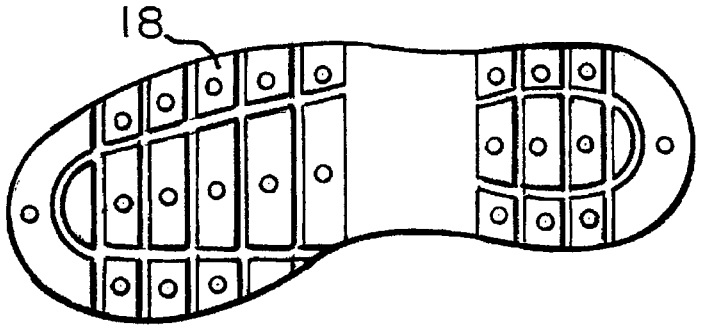
FIG. 3 is a bottom plan view showing a third modification of the bottom surface of the sole.
Figure 4:
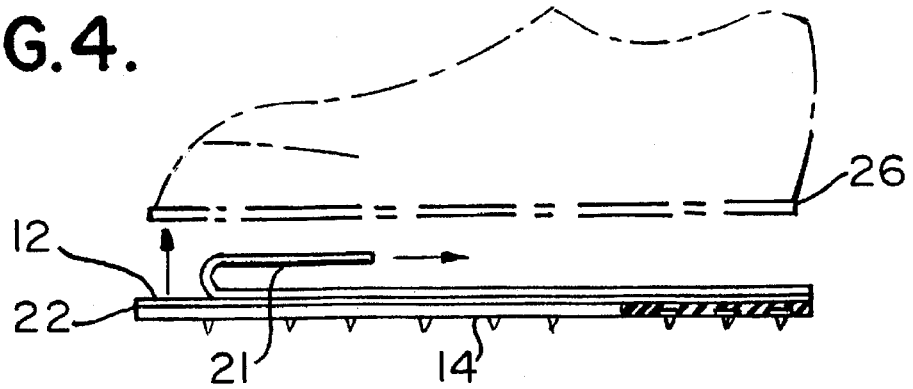
FIG. 4 is a side elevational view in exploded form showing the manner in which a sole according to my invention may be attached to footwear having an existing sole.

In the embodiment shown in FIG. 2, the bottom surface of the sole has cleats, which term will be used to define a resilient outward projection, normally made of rubber or synthetic material, which protrudes from the bottom surface of the footwear sole and are well-known in the art. Such cleats are shown as being circular in bottom plan and view, and are identified generally by reference numeral 18. As will be further apparent, however, some of the cleats have metal studs 34 embedded within them. Cleats that carry such metal studs are further identified by reference numeral 19. Finally, there are also cleats, identified by reference numeral 21, which terminate not in a flat surface, such as cleats 18, or in a metal stud, such as cleats 19, but in a nipple formed from the same material as the body of the cleat. These cleats are identified by reference numeral 21.

Figure 8:
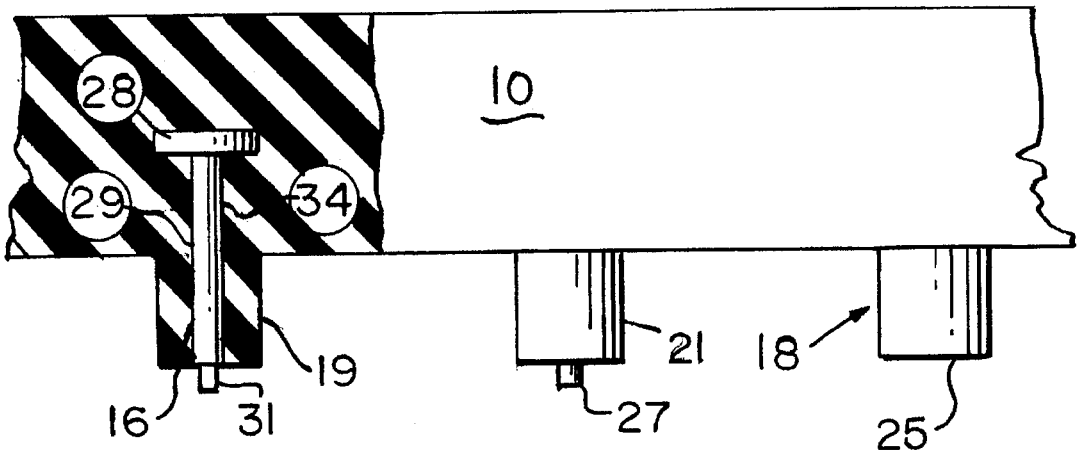
FIG. 8 is an enlarged sectional view showing in detail certain elements of the embodiment of FIG. 2.

As best seen in FIG. 8, the three different kinds of cleats 18, 19 and 21 are shown side-by-side for the purposes of comparison, although they need not be arranged in that sequence in an actual sole. Thus, cleat 19 has a metal stud 16 embedded and molded within it and within the sole 10 of the footwear. For the purposes of illustration, the stud 16 is shown in cross-section with an anchoring portion 28, an intermediate shaft 29, and a tip portion 31. As will be apparent, the metal stud 16 is embedded within the sole 10 and cleat 19 so that only the tip portion 31 of the stud protrudes beyond the lower surface 26 of cleat 19. Thus, the stud 16 is firmly embedded not only within sole 10 but also within the resilient cleats 19.

As also illustrated in FIG. 8, some of the cleats, which in this case are identified as cleats 21, do not have a metal stud that extends axially of the cleat. Instead these cleats 19 are of the same structure as cleats 19, which have metal stud 16, except that the cleats terminate in a nipple 27 which is formed from the same resilient material as the cleat 21. Also shown in FIG. 8 is a cleat 18 which has neither nipple 27 nor metal stud 16 and terminates in a substantially flat lower surface 28. As a consequence, in one preferred embodiment of my invention, there are three different types of cleats formed from natural or synthetic rubber, or a synthetic resin, that are resilient and which absorb shock when a wearer of footwear having my sole is walking on a variety of surfaces. These are cleats 18 which are flat bottomed rubber cleats 18, cleats 21 which are similar to standard rubber cleats except that they have a nipple 27 extending downwardly from their lower surface, and cleats 19, which have a metal stud embedded in them in such a manner that the tip portion and, if found desirable, a part of the shaft 29 of the stud can protrude from the lower surface 26 of that cleat 21.

When an embodiment of my invention including resilient cleats is employed, cleats 19 carrying metal studs may occupy about 15 to 40 percent of the totality of the cleats on the bottom surface of the sole. When cleats are employed having nipples similar to cleats 21, it has been found desirable that about 10 to 30 percent of the totality of cleats be similar to cleats 21. It will, therefore, be apparent that the remainder of the cleats, which are conventional in form and similar to cleats 18, will be the remainder of the cleats used in my sole. Incidentally, as used herein, the term cleat is used to refer to a non-metallic, resilient protrusion extending downwardly from the bottom of the sole of my footwear, and that such term is used rather than stud, which is utilized herein to refer to a harder, less resilient, and generally metallic article projecting downwardly from the sole.

As stated, it is considered to be a significant part of the present invention that there be coordination between the compressive deformation of the resilient material from which the sole and, in that embodiment, the cleat are formed, and the distance by which the stud and generally the tip portion thereof extend outwardly beyond the plane of the bottom surface of the sole and, where a cleat is used, the lower surface of the cleat. Thus, in the embodiment of my invention without cleats, the extension of the metal stud beyond the bottom surface of the sole is such that, when the footwear is worn and the weight of the wearer exerts generally axial pressure on the metal studs, the resilient material from which the sole is formed will enable the stud to retract within the resilient sole until the tip of the stud is substantially at the plane of the bottom surface of the sole. In the embodiment in which cleats are present, the metal stud that is present in at least some of the cleats extend beyond the plane of the lower surface of the cleats such a distance that, when the footwear is worn and a downward, walking or running pressure is applied to the studs, those studs will retract due to the compressive resilience of the material from which the cleat and the sole are formed, until the tip portion of the stud is substantially at the plane of the lower surface of the cleat.

For the purposes of illustration and what I presently consider to be the best mode of my invention, the tip portions of the metal studs should extend approximately 0.085 to 0.095 inch beyond the plane of the bottom surface of the sole or cleat. Approximately 0.090 inch is presently most preferred. With regard to the material from which the sole and, in that embodiment, cleats of the present invention are formed, it is presently considered preferable that both the sole and cleat be formed from synthetic or natural rubber having a hardness between about 0.065 and 0.090 Durometer Shore A. When the resilience of sole and cleat are in these general ranges and, in some instances, even beyond these ranges, and the tip portions of the metal studs extend beyond the lower surfaces of the sole or cleats, it has been found that when a person for whom the footwear is designed steps on soft surfaces, e.g., slush or sod, the metal studs will tend to penetrate the soft surface and thereby enable the wearer of footwear to gain significant purchase on that slippery material. However, when a runner wearing my footwear then runs from sod onto a harder, more compact surface, e.g., cement, the tip portions of the metal studs will, by his weight, be forced inwardly into the sole and cleat so that when the full weight of the runner is exerted at a 90-degree angle on the metal stud, that stud will be forced to retract into the resilient material from which the sole and cleat are formed such that the tip portion of the stud is positioned at approximately the plane of the lower surface of the sole or cleat. In this manner, the wearer will still have traction on a hard surface because the studs will not extend beyond the plane of the bottom surface and thereby make running on the compacted surface difficult or hazardous. Further, the additional use of cleats either in conventional form having a flat bottom surface and/or with a nipple extending from the center of the flat bottom surface, permits the footwear soles of the present invention to be utilized on an even wider variety of running surfaces.

While the present invention has been described with respect to specific embodiments thereof, it will be apparent to those of skill-in-the-art that certain variations, modifications, and alterations in the disclosures of those embodiments may be made without departing from the spirit of my invention. It is desired, therefore, that the present invention include all such alterations, variations, and modifications, and that it be limited only by the scope, including equivalents, of the following, appended claims.

I claim:

1. A resilient, all-surface sole for footwear, said sole having a bottom surface and an upper surface and being formed from resilient material of a substantial thickness located between said surfaces and being subject to compressive deformation, comprising:

a plurality of metal studs mounted in said sole, each of said studs having an anchoring portion embedded in and surrounded by said resilient material and secured by said material against dislodgement under normal use of said footwear, a shaft portion fixed to said anchoring portion and extending away from said anchoring portion, and a tip portion in which said shaft portion terminates, said stud having a length such that when said footwear is unworn, said tip portion extends outwardly beyond the plane of said bottom surface, the compressive deformation of said resilient material being coordinated with the distance said tip portion extends beyond the plane of said sole bottom surface of said unworn footwear such that pressure exerted on said metal studs by the weight of a wearer of said footwear will cause said studs to retract within said resilient sole until said tip of said stud is substantially at the plane of said bottom surface of said sole.

2. A resilient, all-surface sole for footwear as claimed in claim 1, in which said resilient material is natural or synthetic rubber.

3. A resilient, all-surface sole for footwear as claimed in claim 2, in which the hardness of said rubber is between about 65 to 90 Durometer Shore A.

4. A resilient, all-surface sole for footwear as claimed in claim 3, in which said hardness is between about 70 and 80 Durometer Shore A.

5. A resilient, all-surface sole for footwear as claimed in claim 1, in which said metal studs extend between about 0.085 to 0.095 inches beyond the plane of said bottom surface of said sole.

6. A resilient, all-surface sole for footwear as claimed in claim 1, in which said thickness of said sole is about 0.095 to 0.110 inches.

7. A resilient, all-surface sole for footwear as claimed in claim 1, in which said sole upper surface carries a coating of adhesive so that said sole can be fixed to the sole of existing footwear.

8. A resilient, all-surface sole for footwear as claimed in claim 7, in which said sole is formed from natural or synthetic rubber.

9. A resilient, all-surface sole for footwear as claimed in claim 7, in which said cleats are formed from natural or synthetic rubber.

10. A resilient, all-surface sole for footwear as claimed in claimed 7, in which the hardness of said cleat second resilient material is between about 0.065 and 0.090 Durometer Shore A.

11. A resilient, all-surface sole for footwear as claimed in claim 1, in which said sole is formed from a synthetic resin.

12. A resilient, all-surface sole for footwear, said sole having a bottom surface and an upper surface and being formed from a resilient material of substantial thickness located between said surfaces and being subject to compressive deformation, comprising:

a plurality of cleats formed from a second resilient material attached to and spaced along said bottom surface of said sole, said cleats terminating outwardly in a lower surface to contact a surface on which the wearer walks;

a plurality of metal studs mounted in said sole and extending axially through at least some of said cleats, each of said studs having an anchoring portion embedded in and surrounded by said resilient material of said sole and secured by said material against dislodgement under normal use of said footwear, a shaft portion fixed to said anchoring portion and extending away from said anchoring portion substantially axially with said cleat, and a tip portion in which said shaft portion terminates, said stud having a length such that when said footwear is unworn, said tip portion extends outwardly beyond the plane of said lower surface of said cleat, the compressive deformation of said resilient material of said sole and said second resilient material of said cleat being coordinated with the distance said tip portion of said stud extends beyond the plane of said cleat lower surface of said unworn footwear such that pressure exerted on said metal studs by the weight of the wearer of said footwear will cause said studs to retract within said resilient sole and said resilient cleats until said tip of said stud is substantially at the plane of said lower surface of said cleat.

13. A resilient, all-surface sole for footwear as claimed in claim 12, in which said sole and said cleats are formed from natural or synthetic rubber.

14. A resilient, all-surface sole for footwear as claimed in claim 12, in which said tip portions of said metal studs extend from about 0.085 to 0.095 inch beyond the plane of said cleat lower surface when said footwear is unworn.

15. A resilient, all-surface sole for footwear as claimed in claimed 12, in which the hardness of said sole resilient material is between about 0.065 to 0.090 Durometer Shore A.

16. A resilient, all-surface sole for footwear as claimed in claimed 12, in which the hardness of said sole resilient material and said cleat second resilient material is about 0.065 to 0.090 Durometer Shore A.

17. A resilient, all-surface sole for footwear as claimed in claimed 12, in which about 15 to 40 percent of said cleats extending from the bottom surface of said sole have said metal studs extending through them.

18. A resilient, all-surface sole for footwear as claimed in claimed 12, in which about 10 to 30 percent of said cleats have resilient nipples extending outwardly from said cleat lower surfaces.

19. A resilient, all-surface sole for footwear as claimed in claimed 12, in which said upper surface of said sole carries a coating of adhesive so that said sole can be fixed to the sole of existing footwear.

* * * * *